US005300979A

United States Patent [19]

Tsukakoshi et al.

[11] Patent Number: 5,300,979

[45] Date of Patent: Apr. 5, 1994

[54] CLAMSHELL TYPE IMAGE FORMING APPARATUS

[75] Inventors: Yukio Tsukakoshi; Kiyoshi Miyai, both of Ogaki; Satoshi Hirose; Tatsuhito Horiuchi, both of Anpachi; Minoru Kumida, Gifu, all of Japan

[73] Assignee: Sanyo Electric Co., Ltd., Osaka, Japan

[21] Appl. No.: 22,779

[22] Filed: Feb. 23, 1993

Related U.S. Application Data

[63] Continuation of Ser. No. 772,697, Oct. 7, 1991, abandoned.

[30] Foreign Application Priority Data

Oct. 17, 1990 [JP] Japan ..... 2-280513
Oct. 18, 1990 [JP] Japan ..... 2-280739

[51] Int. Cl.[5] ..... G03G 15/00; G03G 15/06

[52] U.S. Cl. ..... 355/200; 355/210; 355/245

[58] Field of Search ..... 355/200, 211, 245, 260, 355/210

[56] References Cited

U.S. PATENT DOCUMENTS

| | | | |
|---|---|---|---|
| 4,114,998 | 9/1978 | Shimizu et al. | 355/211 |
| 4,339,196 | 7/1982 | Beck et al. | 355/245 |
| 4,588,280 | 5/1986 | Ogawa et al. | 355/200 |
| 4,598,993 | 7/1986 | Mizutani et al. | 355/245 X |
| 4,702,587 | 10/1987 | Miyoshi | 355/200 |
| 4,862,209 | 8/1989 | Sakamoto et al. | 355/211 |
| 4,862,212 | 8/1989 | Tanzawa et al. | 355/260 X |
| 4,896,193 | 1/1990 | Kagiura et al. | 355/245 X |
| 4,989,037 | 1/1991 | Nagatsuna | 355/200 |
| 5,089,849 | 2/1992 | Hiraoka | 355/211 |

FOREIGN PATENT DOCUMENTS

| | | | |
|---|---|---|---|
| 60-76771 | 5/1985 | Japan | 355/245 |
| 61-198171 | 9/1986 | Japan | 355/200 |

*Primary Examiner*—A. T. Grimley
*Assistant Examiner*—Shuk Y. Lee
*Attorney, Agent, or Firm*—Darby & Darby

[57] ABSTRACT

A clamshell type image forming apparatus, in which a process cartridge included in an upper structure is supported pivotably to a fixed position and a dismounting position against the upper structure, a developing unit included in a lower structure is supported thereon pivotably to a position just opposing to an image holding medium and a position spaced therefrom, and a plate spring which urges the developing unit toward a position spaced from the image holding medium is disposed on the lower structure side, and a plate spring which urges the developing unit toward a position just opposing to the image holding medium is disposed on the upper structure side, thereby inconveniences produced by providing the process cartridge on the upper structure are solved, and by reducing a collision between the developing unit and the image holding medium due to the open-and-close operation of the upper structure, it is possible to prevent a damage of the process cartridge including the image holding medium.

8 Claims, 5 Drawing Sheets

CLAMSHELL TYPE IMAGE FORMING APPARATUS

This is a continuation, of application Ser. No. 07/772,697, filed Oct. 7, 1991, now abandoned.

BACKGROUND OF THE INVENTION

1. Field of the Invention

The present invention relates to a so-called clamshell type image forming apparatus utilized for a printer, copying machine and the like.

2. Description of the Prior Art

A clamshell type image forming apparatus, disclosed in, for example, U.S. Pat. No. 4,588,280, is, generally, divided into an upper structure including an optical system, process cartridge and associated elements and a lower structure including a paper feed cassette and associated elements with a conveying path of recording paper interposed therebetween. The apparatus is and constructed such that the upper structure is supported so as to close and open vertically against the lower structure like a clamshell. In such a clamshell type image forming apparatus, it is advantageous in maintenance and checking and when conveying troubles on recording paper have to be responded immediately.

In addition, U.S. Pat. No. 4,598,993 discloses a process cartridge having a developing unit.

In the process cartridge included in the upper structure of the clamshell type image forming apparatus, usually, a sliding construction in which it can be engaged and disengaged lengthwise along a sliding guide member is adopted. In such a construction, however, since the supporting mechanisms such as the sliding guide member became complicated and the weight of the upper structure becomes heavier, the supporting mechanism itself must be made large. Moreover, a positioning accuracy of an optical system and photoreceptor which constitutes the process cartridge is apt to deteriorate and thus it is difficult to maintain proper image definition for a long period of time.

Also, in the clamshell type image forming apparatus wherein the developing unit is constructed separate from the process cartridge and the developing unit is disposed in the lower structure, though the developing unit and an image holding medium are positioned when the upper structure is brought to the close position, at this time, there is the possibility that the image holding medium and the developing unit will contact each other and the image holding medium may break due to the impact occurred thereat, or in order to avoid such problem, the supporting construction of the developing unit becomes complicated.

SUMMARY OF THE INVENTION

The present invention has been devised in view of such circumstances. Therefore, it is a primary object thereof to provide a clamshell type image forming apparatus, in which inconveniences as aforementioned produced by installing a process cartridge in an upper structure can be solved.

It is another object of the present invention to provide a clamshell type image forming apparatus, in which the process cartridge including an image holding medium is not damaged, by reducing the impact between a developing unit and the image holding medium caused by the open-and-close operation of the upper structure.

The clamshell type image forming apparatus of the invention comprises: an upper structure having an optical system and a process cartridge including an image holding medium; and a lower structure having a developing unit. There is also pivoting means for pivotably supporting the upper structure in two states against the lower structure, one being a closed position being an operable state, and an open position being an inoperable state. The invention also includes means for supporting the process cartridge pivotably in a fixed position and a dismounting position against the upper structure.

In the clamshell type image forming apparatus of the invention thus constructed, since the optical system and the process cartridge are moved in the open-and-close fashion together with the upper structure, the positional deviation of the optical system is reduced. Further, only the process cartridge can be rotated independently to its fixed position and dismounting position at the open position of the upper structure.

The clamshell type image forming apparatus of the invention also comprises: an upper structure having an optical system and a process cartridge including the image holding medium; a lower structure having the developing unit; pivoting means for pivotably supporting the upper structure to take two states against the lower structure, one an open position being an inoperable state; means for supporting the developing unit on the lower structure pivotably to a first position just opposing to the image holding medium and a second position spaced therefrom. The invention includes a first resilient member which is mounted to the lower structure to urge the developing unit toward the second position spaced from the image holding medium; and a second resilient member which is mounted to the upper structure to urge the developing unit toward the first position just opposing the image holding medium.

In the clamshell type image forming apparatus of the invention, the developing unit is supported resiliently at the second position by the first resilient member when the upper structure is in the open position, and the developing unit is urged toward the first position just opposing to the image holding medium against the resilience force of the first resilient member by the second resilient member when the upper structure is moved to the closed position, so that as the upper structure is rotated to the closed position the developing unit is gradually positioned at an optimum position and fixed.

The above and further objects and features of the invention will more fully be apparent from the following detailed description with accompanying drawings.

DESCRIPTION OF THE PREFERRED EMBODIMENTS

In the following, an embodiment in which a clamshell type image forming apparatus of the present invention is adopted to a copying machine will be specifically explained with reference to the drawings.

Figure 1:
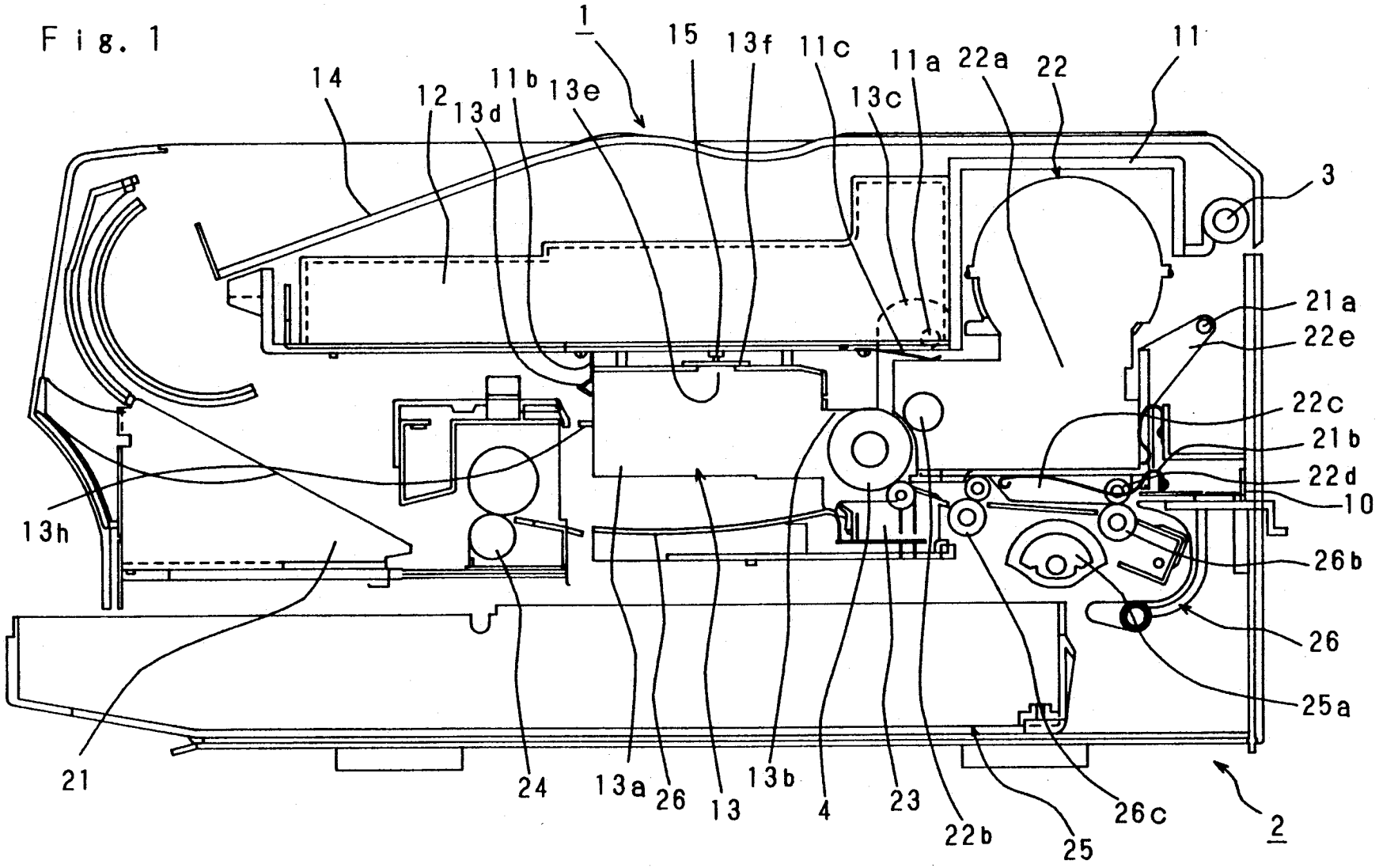
FIG. 1 is a schematic vertical sectional view of a copying machine as an embodiment of a clamshell type image forming apparatus according to the present invention.
Figure 2:
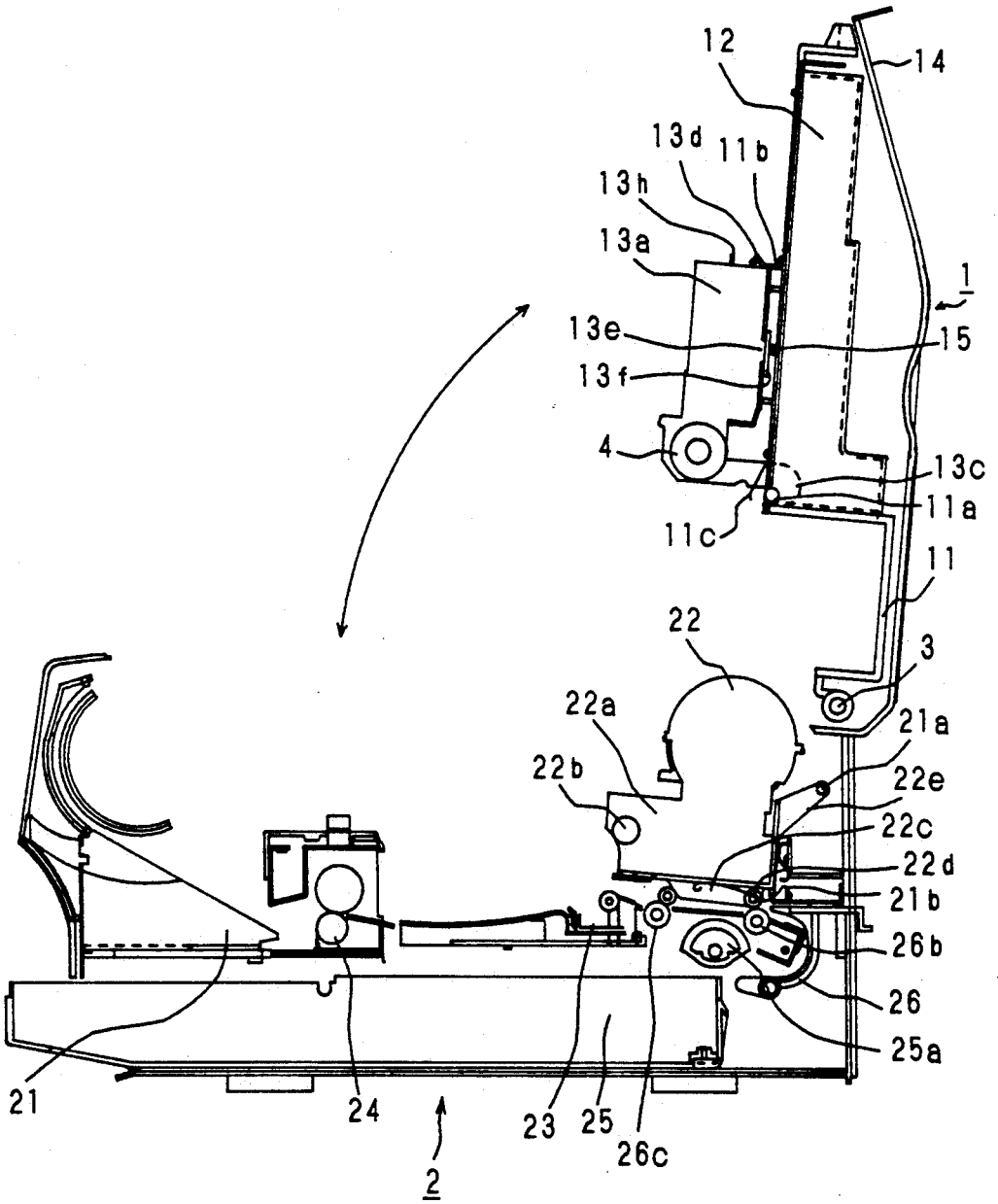
FIG. 2 is a schematic vertical sectional view showing a copying machine whose upper structure is open.

FIG. 1 is a schematic vertical sectional view of the image forming apparatus according to the invention, and FIG. 2 is a schematic vertical sectional view showing a state wherein an upper structure is open.

In FIG. 1 and FIG. 2, numeral 1 designates an upper structure, numeral 2 designates a lower structure, numeral 3 designate a supporting shaft for pivotably supporting the upper and lower structures with respect to each other, and numeral 4 designates a photoreceptor as an image holding medium.

The upper structure 1 is pivotably supported at its one end on the lower structure 2 by the support shaft 3 which is the supporting means and is constituted in a clamshell construction which can be opened and closed vertically against the lower structure 2. Normally, as shown in FIG. 1, the upper structure 1 is fixed at a close position against the lower structure 2 and is in an operable state. At maintenance and checking, as shown in FIG. 2, it is so constructed that the upper structure 1 is rotated generally 90° upward around the shaft 3 so as to be moved to the open position.

In the upper structure 1, an optical system 12, a process cartridge 13 including a photoreceptor 4, a paper discharge tray 14 and a document table, not shown, are disposed in an upper chassis 11. Meanwhile, in the lower structure 2, a developing unit 22, a transfer unit 23, a fixing unit 24, a paper feed cassette 25 and a conveying path 26 through which recording paper fed from the paper feed cassette 25 is conveyed to the discharge tray 14 of the upper structure 1 are disposed in a lower chassis 21.

In the state shown in FIG. 1 wherein the upper structure 1 is closed against the lower structure 2, a toner recovery container 13*a* with a building in cleaning device, developing unit 22 and transfer unit 23 which are in unit with the photoreceptor 4 are disposed around the photoreceptor 4, and between the paper feed cassette 25 and the paper discharge tray 14, the conveying path 26 of the recording paper is formed along the border of the upper structure 1 and the lower structure 2.

Figure 3:
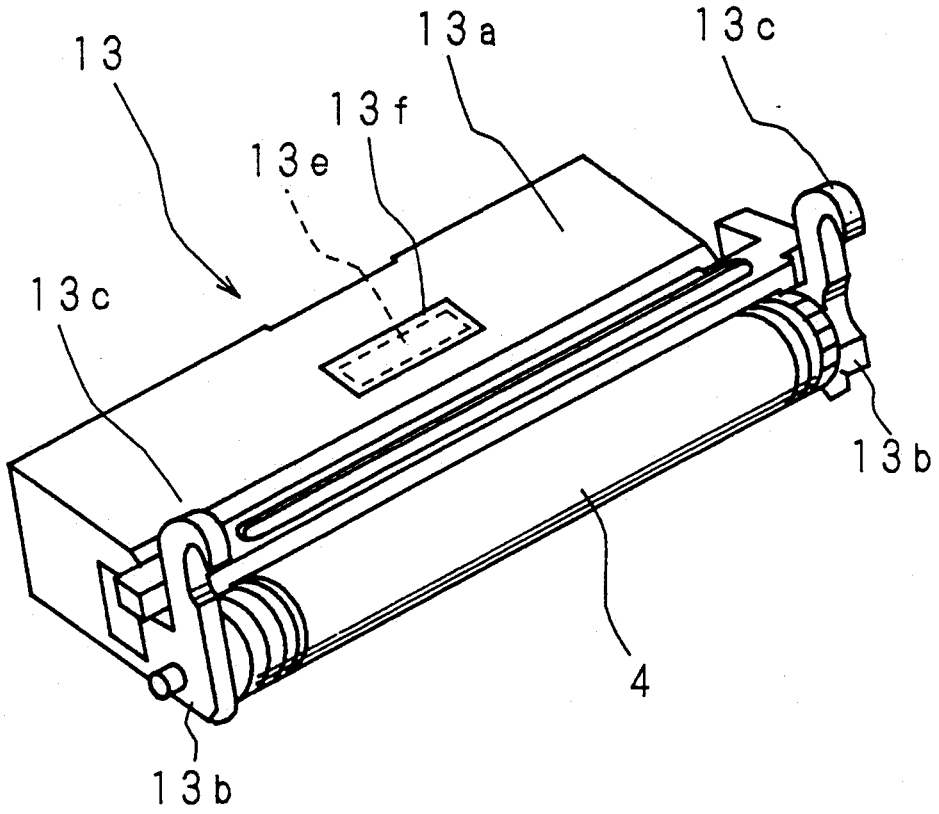
FIG. 3 is a perspective view showing an appearance of a process cartridge.

FIG. 3 is a perspective view showing an appearance of the process cartridge 13.

The process cartridge 13 is formed by the photoreceptor 4, the toner recovery container 13*a* constituting the cleaning unit, and the like. The photoreceptor 4 is formed by disposing a photoconductive layer around an aluminum cylinder, and is supported between wing plates 13*b* at both ends of the toner recovery container 13*a* facing the opening thereof.

The toner recovery container 13 includes a brush, and the like constituting the cleaning unit therein. At the upper portion of the toner recovery container 13*a*, there is formed an aperture 13*e* onto which a flexible film 13*f* is fastened on the outside.

The process cartridge 13 so constructed is hung removably on a support shaft 11*a* provided in the upper chassis 11, by hooks 13*c* projecting upward from the wing plates 13*a* at the both opening ends. That is, the shaft 11*a* is means for supporting the process cartridge 13 pivotably on the upper structure 1.

On the other hand, on the other end portion of the process cartridge 13 (left hand side in FIG. 1), a projection portion 13*d* is provided on its rear side. On the upper chassis 11, an engaging member 11*b* made of a plate spring and having a dent is fixed toward the lower structure 2.

Accordingly, the process cartridge 13 is rotated around the support shaft 11*a* and is supported removably by the upper structure 1 by engagement of the projection portion 13*d* to the dent of the engaging member 11*b*.

Now, on the lower surface of the upper chassis 11, a microswitch 15 which can contact to the film 13*f* in the state shown in FIG. 1 is provided.

The microswitch 15 is facing closely to the film 13*f* in the state shown in FIG. 1. However, when the toner recovery container 13*a* is filled with the recovered toner and the film 13*f* expands outwardly, the film 13*f* touches the microswitch 15 to warn that toner recovery container 13*a* is filled up.

Reference character 13*h* indicates a knob which is provided, for the convenience sake of the user, for taking out the process cartridge 13.

Figure 4:
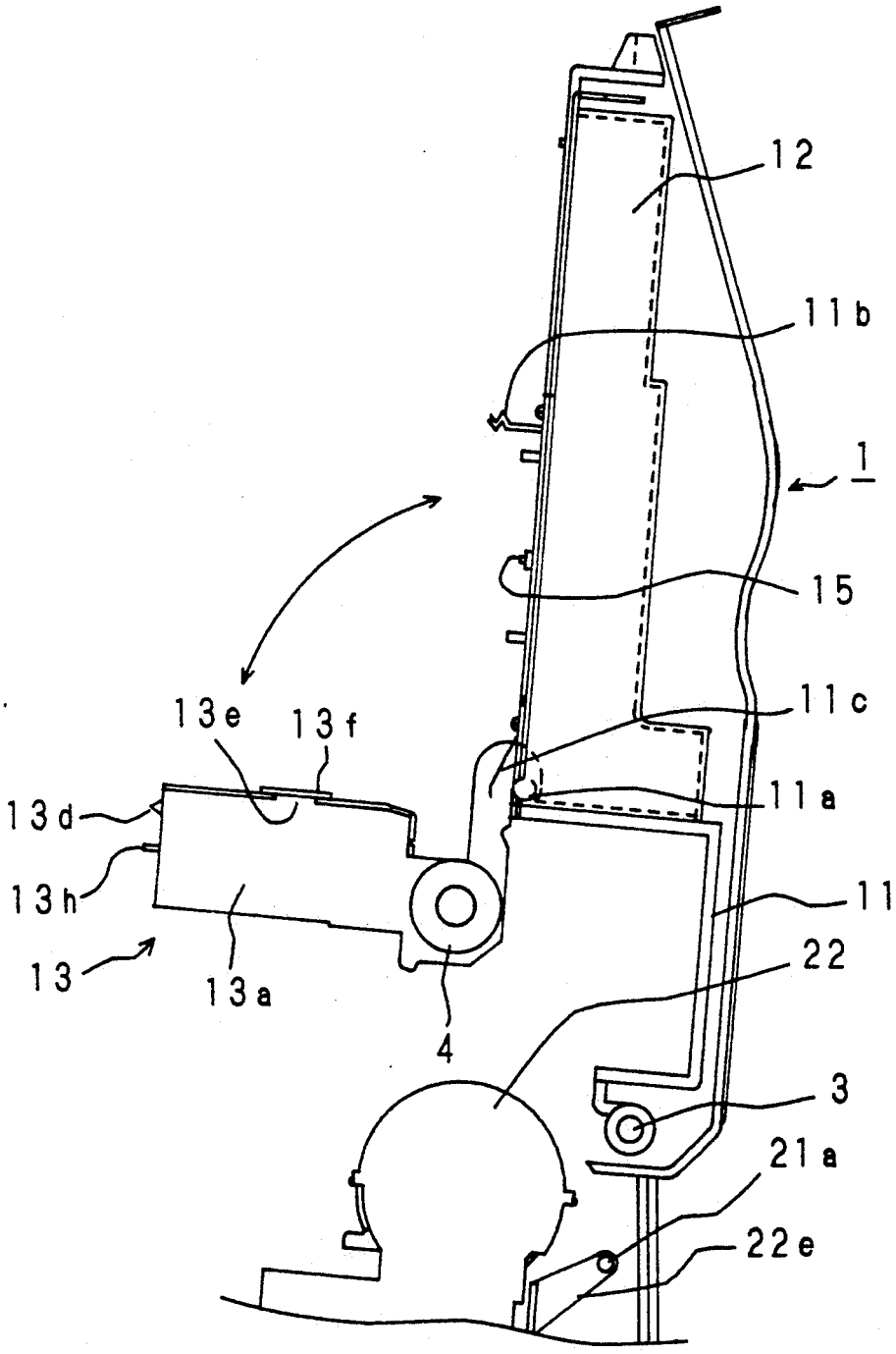
FIG. 4 is an explanatory view of the rotating operation of a process cartridge.

Besides moving integrally with the upper structure 1 to the position shown in FIG. 2, the process cartridge 13 can be moved to the fixed position and the dismounting position which is rotated 90° therefrom around the support shaft 11*a*, by disengaging the projection portion 13*d* from the engaging member 11*b* as shown in FIG. 4.

Figure 5:
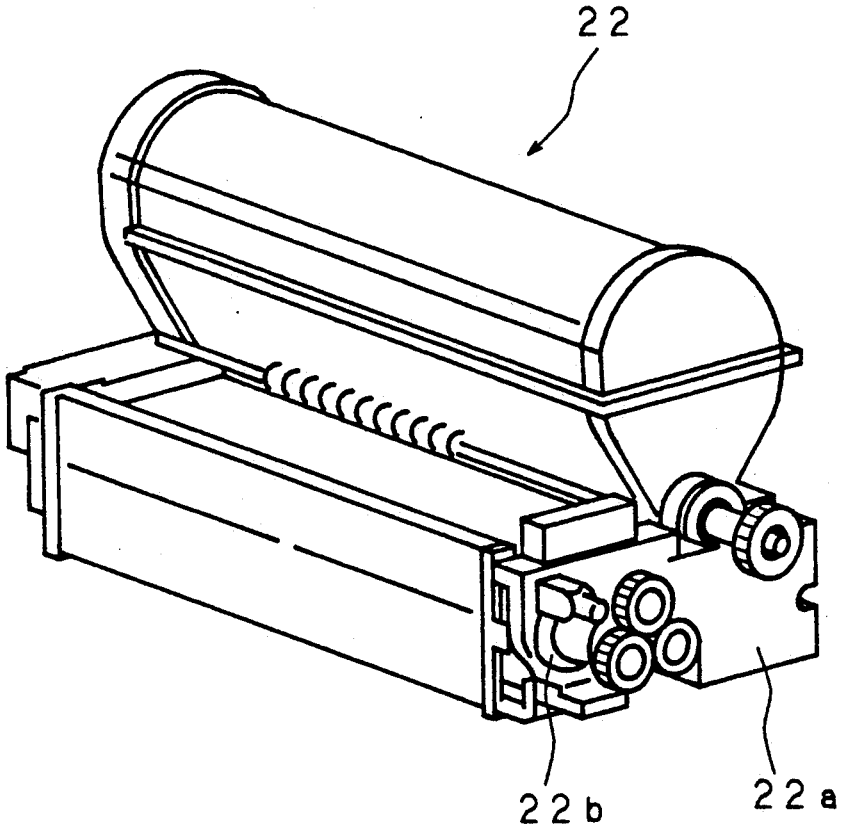
FIG. 5 is a perspective view showing a configuration of a developing unit.

FIG. 5 is a perspective view showing a configuration of a developing unit 22.

The developing unit 22 is constituted by a toner box 22*a* and a developing sleeve 22*b* facing the opening thereof, and the like.

Under the toner 22*a*, two ribs 22*c* are disposed in parallel so as to face both side ends of the conveying path 26 of recording paper breadthwise (refer to FIG. 1 and FIG. 2). Between the ribs 22*c*, a first resist roller 26*b* and a roller 22*d* contacting thereto and rolling are supported.

The entire developing unit 22 including the developing sleeve 22*b* is supported by a support shaft 21*a* provided on the lower chassis 21 via a support arm 22*e*, and further, the upper and lower portions of the toner box 22*a* are supported by a plate spring 11*c* which is a second resilient member disposed on the upper chassis 11, and a plate spring 21*b* which is a second resilient member disposed on the lower chassis 21.

That is, in the case where the upper structure 1 is at the close position as shown in FIG. 1, the developing unit 22 is forced toward the lower structure 2 against the resilient force of the plate spring 21*b* by the plate spring 11*c*, and is positioned at a position just opposing to the photoreceptor 4. On the other hand, in the case where the upper structure 1 is in the open position as shown in FIG. 2, the developing unit 22 is pressed upward by the plate spring 21*b* and is supported at a position spaced from the just opposed position against the photoreceptor 4.

The transfer unit 23 is disposed under the photoreceptor 4 in a position beyond the conveying path 26 of the recording paper. The transfer unit 23 transfer a toner image on the surface of the photoreceptor 4 to a recording paper surface by applying electric charges to the recording paper passing through the conveying path 26.

The conveying path 26 has its starting end at a paper feeding end of the paper feed cassette 25 and an extended position of the paper feeding roller 25*a* opposed thereto, and reverses upward therefrom to reach under the photoreceptor 4 via first and second resist rollers 26*b*, 26*c* on the way, and further, reverses upward via the fixing unit 24 to link to the paper discharge tray 14.

The clamshell type image forming apparatus of the present invention thus constructed will be described in the following.

First, when a start button is pressed after placing a document on a document table, not shown, the document is scanned by the optical system 12, and the photoreceptor 4 is exposed by the document image to form an electrostatic latent image on the photoreceptor 4. By the toner contacting to the surface of the photoreceptor 4 whereon the electrostatic latent image is formed via the developing sleeve 22*b* of the developing unit 22, a toner image corresponding to the latent image formed thereon is formed on the photoreceptor 4, which is rotated to a position facing the transfer unit 23.

Meanwhile, recording paper is drawn out from the paper feed cassette 25 and moved along the conveying path 26 to reach above the transfer unit 23 through the first and second resist rollers 26*b* and 26*c*. Then, the recording paper given charges and the photoreceptor 4 are moved and rotated in synchronism, and the toner image on the surface of the photoreceptor 4 is transferred onto the recording paper. The residual toner on the photoreceptor 4 is removed by the cleaning unit and gradually stored in the toner recovery container 13*a*.

On the other hand, the toner image transferred onto the recording paper is fixed thereon by pressing the recording paper in the state wherein the toner is heated and fused by the fixing unit 24. Then, the recording paper onto which the toner image is fixed is discharged to the paper discharge tray 14.

When the toner recovery container 13*a* is filled up with the recovered toner, the flexible film 13*f* stuck to the upper aperture 13*e* is pressed and expanded outward. Thereby, the microswitch 15 is switched on to raise an alarm, or light or flicker a lamp to signed replacement of the toner recovery container.

To replace the toner recovery container 13*a* by the user when an alarm and the like indicating the replacement is raised, following procedures should be taken.

First, after switching off a power source, the upper structure 1 is rotated generally 90° around the support shaft 3 from the position shown in FIG. 1 to the open position shown in FIG. 2. In this state, since the toner recovery container 13*a* is supported on the supported shaft 11*a* by the hooks 13*c* disposed thereunder and the projection portion 13*d* disposed thereon is engaged to the engaging member 11*b*, it is supported on the upper structure 1 in the same state as shown in FIG. 1.

Next, the user detaches the engaging member 11*b* from the projection portion 13*d* of the toner recovery container 13*a*, which is rotated 90° around the support shaft 11*a* to the position shown in FIG. 4. By lifting the toner recovery container 13*a* slightly upward and drawing out leftward, the hooks 13*c* disengage from the support shaft 11*a*, so that the user can remove the toner recovery container 13*a* from the upper structure 1 and the entire process cartridge 13 including the photoreceptor 4 and the cleaning unit can be replaced.

As shown in FIG. 4, when the user engages the hooks 13*c* of a new process cartridge 13 to the support shaft 11*a* and rotates the entire process cartridge 13 upward around the support shaft 11*a*, the engaging member 11*b* engages to the projection portion 13*d* of the process cartridge 13 and the state shown in FIG. 2 is achieved.

Thereafter, the user rotates the upper structure 1 just to the close position shown in FIG. 1.

In the apparatus of the invention, at conveying troubles of the recording paper or at maintenance and checking, the upper structure 1 is moved to the open position shown in FIG. 2. At this time, the developing unit 22 is pressed upward by the plate spring 21*b* and is rotated around the support shaft 21*a*, thereby it is apart from the position just opposing to the photoreceptor 4 shown in FIG. 1 and takes to the supporting state after being rotated slightly upward.

When the upper structure 1 is rotated to the close position after finishing the maintenance and checking, first, the plate spring 11*c* provided on the upper structure 1 contacts to the upper surface of the toner box 22*a* of the developing unit 22. The plate spring 11*c* rotates the toner box 22*a* downward around the support shaft 21*a* against the plate spring 21*b*, and when the upper structure 1 reaches the close position, the developing unit 22 is positioned simultaneously at the position just opposing to the photoreceptor 4. Accordingly, the impact caused by direct contact between the process cartridge 13 including the photoreceptor 4 and the developing unit 22 is reduced to avoid photoreceptor 4 damage.

In the case where the upper structure 1 is at the close position, the position of the photoreceptor 4 is lower than that of the developing unit 22.

In the embodiment aforementioned though an example of process cartridge 13 in which the photoreceptor 4 and the toner recovery container 13*a* building in the cleaning unit is intergrated has been shown, it is not limited thereto, it will be appreciated that the photorecptor 4 and the developing unit, or the photoreceptor, developing unit and the cleaning may be combined.

Also, in the aforesaid embodiment, though the configuration in which the plate springs 11*c* and 21*b* are used as urging means of the developing unit 22 has been described, it is not limited thereto, it is to be understood that various known resilient materials may also be used.

As particularly described heretofore, in the clamshell type image forming apparatus of the invention, since an image forming unit is supported pivotably to the fixed position and dismounting position on the upper structure which is supported pivotably against the lower structure, the process cartridge can be mounted and dismounted easily, thus an image forming unit and an optical system are postioned stably and stable clear image can be kept for a long time, besides, the supporting mechanism is simplified and the upper structure can be made light.

Furthermore, in the apparatus of the invention, the impact caused by direct contact between the photoreceptor and the developing unit can be prevented reliably, results in a long service life of the photoreceptor.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A clamshell type image forming apparatus, comprising:

an upper structure having an optical system and a process cartridge including an image holding medium;

a lower structure having a developing unit;

first pivoting means for pivotably supporting said upper structure to said lower structure to have two positions relative to said lower structure, a closed position being an operable state for the apparatus, and an open position being an inoperable state in which a paper conveying path is open; and supporting means for pivotably supporting said process cartridge to said upper structure in both a fixed position and a dismounting position, said supporting means including, second pivoting means on one of said upper structure and said process cartridge, and first engaging means acceptable by said second pivoting means on the other of said upper structure and said process cartridge for pivotably supporting said process cartridge to said upper structure, second engaging means on one of said upper structure and said process cartridge and third engaging means engaging with and disengagable from said second engaging means on the other of said upper structure and said process cartridge, said third engaging means being accessible when the upper structure is open, disengagement of said third engaging means from said second engaging means permitting said process cartridge to be pivoted by its own weight as it pivots by said second pivoting means and first engaging means from a position fixed to the upper structure to one away from the upper structure in which it can be removed by disengaged of said first engaging means from said second pivoting means.

2. A clamshell type image forming apparatus as set forth in claim 1, wherein said second pivoting means is a support shaft, and said first engaging means is a hook which fits on said support shaft.

3. A clamshell type image forming apparatus, comprising:

an upper structure having an optical system and a process cartridge including an image holding medium;

a lower structure having a developing unit;

pivoting means for pivotably supporting said upper structure to said lower structure to have two positions relative to said lower structure, a closed position being an operable state for the apparatus, and an open position being an inoperable state in which a paper conveying path is open;

means for pivotably supporting said developing unit on said lower structure in a first position just opposing to said image holding medium and a second portion spaced therefrom;

a first resilient member interlocked with the operation of pivoting said upper structure from a closed position to an open position relative to said lower structure, and is mounted to said lower structure for urging said developing unit toward said second position spaced from said image holding medium; and a second resilient member interlocked with the operation of pivoting said upper structure from an open position to a closed position and is mounted to said upper structure for urging said developing unit toward said first position just opposing to said image holding medium.

4. A clamshell type image forming apparatus as set forth in claim 3, wherein said first and second resilient members are plate springs.

5. A clamshell type image forming apparatus, comprising:

an upper structure having an optical system and a process cartridge including an image holding medium;

a lower structure having a developing unit;

first pivoting means for pivotably supporting said upper structure to said lower structure to have two positions relative to said lower structure, a closed position being an operable state for the apparatus, and an open position being an inoperable state in which a paper conveying path is open;

first supporting means for pivotably supporting said developing unit on said lower structure in a first position just opposing to said image holding medium and a second position spaced therefrom;

a first resilient member interlocked with the operation of pivoting said upper structure from a closed position to an open position relative to said lower structure, and is mounted to said lower structure for urging said developing unit toward said second position spaced from said image holding medium;

a second resilient member interlocked with the operation of pivoting from an open position to a closed position, and is mounted to said upper structure for urging said developing unit toward said first position just opposing to said image holding medium;

second supporting means for pivotably supporting said process cartridge to said upper structure in both a fixed position and a dismounting position, said second supporting means including;

second pivoting means on one of said upper structure and said process cartridge and first engaging means acceptable by said second pivoting means on the other of said upper structure and said process cartridge for pivotably supporting said process cartridge to said upper structure, second engaging means on one of said upper structure and said process cartridge and third engaging means engaging with and disengagable from said second engaging means on the other of said upper structure and process cartridge, said third engaging means being accessible when the upper structure is open, disengagement of said third engaging means from said second engaging means permitting said process cartridge to be pivoted by its own weight as it pivots by said second pivoting means and first engaging means from a position fixed to the upper structure to one away from the upper structure in which it can be removed by disengaged of said first engaging means from said second pivoting means.

6. A clamshell type image forming apparatus as set forth in claim 5, wherein said second pivoting means is a support shaft, and said first engaging means is a hook which fits on said support shaft.

7. A clamshell type image forming apparatus as set forth in claim 5, wherein said first and second resilient members are plate springs.

8. A clamshell type image forming apparatus as set forth in claim 5, wherein said second supporting means is a support shaft, said first engaging means is a hook which fits on said support shaft, and said first and second resilient members are plate springs.

* * * * *